US006604850B1

(12) United States Patent
Schneider et al.

(10) Patent No.: US 6,604,850 B1
(45) Date of Patent: Aug. 12, 2003

(54) VORTEX STATIC MIXER

(75) Inventors: Gottlieb Schneider, Seuzach (CH); Shaffiq Jaffer, Loveland, OH (US)

(73) Assignee: Sulzer Chemtech AG, Winterthur (CH)

( * ) Notice: Subject to any disclaimer, the term of this patent is extended or adjusted under 35 U.S.C. 154(b) by 0 days.

(21) Appl. No.: 09/552,234

(22) Filed: Apr. 19, 2000

Related U.S. Application Data

(60) Provisional application No. 60/129,946, filed on Apr. 19, 1999.

(51) Int. Cl.[7] ..... B01F 15/00; B01F 5/00

(52) U.S. Cl. ..... 366/175.2; 366/336

(58) Field of Search ..... 366/174.1, 175.2, 366/336–338; 138/42

(56) References Cited

U.S. PATENT DOCUMENTS

| | | | | |
|---|---|---|---|---|
| 3,652,061 A | 3/1972 | Chisholm | ..... | 259/4 |
| 4,307,697 A | 12/1981 | Ong | ..... | 123/590 |
| 4,498,786 A | 2/1985 | Ruscheweyh | ..... | 366/336 |
| 4,643,584 A | 2/1987 | Allocca | ..... | 366/337 |
| 4,758,098 A | 7/1988 | Meyer | ..... | 366/337 |
| 4,929,088 A | 5/1990 | Smith | ..... | 366/337 |
| 4,981,368 A | 1/1991 | Smith | ..... | 366/337 |
| 5,330,267 A | 7/1994 | Tauscher | ..... | 366/336 |
| 5,456,533 A | 10/1995 | Streiff et al. | ..... | 366/173.1 |
| 5,489,153 A | 2/1996 | Berner et al. | ..... | 366/337 |
| 5,758,967 A | 6/1998 | King | ..... | 366/337 |
| 5,813,762 A | 9/1998 | Fleischli et al. | ..... | 366/337 |

FOREIGN PATENT DOCUMENTS

| | | | |
|---|---|---|---|
| TW | 199267 | 11/1992 | ..... A01K/63/04 |

*Primary Examiner*—Matthew O. Savage
(74) *Attorney, Agent, or Firm*—Shook, Hardy & Bacon L.L.P.

(57) ABSTRACT

A static fluid mixer includes a cylindrical flow conduit and at least two inclined, axially spaced, and circumferentially offset internal baffle members for creating counter-rotating vortices in fluids passing through the conduit. The baffle members each have upstream edges spaced from an inner surface of the conduit by a first distance less than a radius of the conduit and downstream edges that are spaced from the inner surface of conduit by a second distance that is greater than the first distance. The baffle members can each have a trapezoidal shape with the downstream edge being smaller in length than the upstream edge thereof.

49 Claims, 3 Drawing Sheets

VORTEX STATIC MIXER

CROSS REFERENCE TO RELATED APPLICATION

Pursuant to 35 U.S.C.§119(e), priority benefits are claimed herein from co-pending provisional application Ser. No. 60/129,946, filed on Apr. 19, 1999, the entirety of the disclosure of which is hereby specifically incorporated herein by reference.

BACKGROUND OF THE INVENTION

1. Field of the Invention

The present application relates generally to static fluid mixers and particularly to static mixers which are useful in generating fluid mixing vortices. The application also relates to methods for mixing fluids using such static mixers.

2. The State of the Prior Art

Static mixers positioned within pipes or other conduits are used in a variety of applications to facilitate mixing of one or more fluid streams flowing within the conduits. For example, static mixers are used to cause a homogeneous distribution of a gas or solid particles within a liquid stream, for mixing of two or more gas or liquid streams, and for mixing a single fluid stream to cause a more uniform distribution of temperature, velocity or other fluid properties.

Certain types of static mixers, known as vortex mixers, are specifically designed to cause mixing by creating swirling vortices of fluid. Examples of such vortex mixers are shown in U.S. Pat. No. 4,307,697 to Ong, U.S. Pat. No. 5,330,267 to Tauscher, U.S. Pat. No. 6,456,533 to Streiff et al., U.S. Pat. Nos. 4,929,088 and 4,981,368 to Smith, U.S. Pat. No. 5,489,153, and U.S. Pat. No. 5,813,762, each of which are incorporated herein by reference.

It is generally desirable for a vortex mixer to provide both a short mixing flow path and a small pressure loss under a variety of different flow conditions and fluid compositions. In addition to achieving high efficiency, it is also desirable for the vortex mixer to be of simple, yet durable, construction for ease of fabrication and reduced cost. The above-referenced vortex mixers meet these objectives to varying degrees; however, the need for an improved vortex mixer continues.

SUMMARY OF THE INVENTION

It is an object of the invention to provide a static mixer that is capable of providing high mixing efficiency across a range of different fluid flow rates so that the mixer may be used in a variety of different applications.

It is also an object of this invention to provide a static mixer that provides high mixing efficiency for two or more substances, such as gas and liquid streams or solid particles and fluid streams, flowing within a conduit across a wide range of ratios of one substance to the other(s) so that the mixer is useful in many different applications.

It is another object of this invention to provide a static mixer that achieves a high degree of mixing while causing only a relatively low pressure drop so that energy losses can be maintained within preselected limits.

It is yet another object of this invention to provide a static mixer that is constructed to impede the collection of fibers or other solid particles on surfaces of the mixer so that the opportunity for clogging of the conduit is minimized when fluids containing fibers or solid particles are flowing through the conduit.

It is a further object of this invention to provide a static mixer that is of a simple configuration and which is made from a minimum amount of material so that low fabrication and manufacturing costs can be obtained.

As a corollary to the preceding object, it is a still further object to provide a static mixer that has a strong and stable construction so that it able to resist vibrations and fluid forces with minimal risk of failure.

To achieve these and other related objects of the invention, a static mixer is provided which, in the preferred embodiment, uses only two baffle members positioned within a preselected length of conduit, one baffle member being positioned downstream from and at approximately a 90 degree offset from the other baffle member. Each baffle member is constructed in a manner to create a pair of counter-rotating vortices that are able to spread across the entire cross section of the conduit. Because of the offset baffle members, the static member produces mixing distribution in two main directions across the cross section of fluid flow, further contributing to homogeneous mixing along a relatively short length of conduit and with a minimum of pressure drop.

Specifically in one broad aspect, the invention provides a static fluid mixer that comprises an elongated fluid flow conduit having a centrally located longitudinally extending axis and an inner generally cylindrical wall extending around said axis and defining a fluid flow path within the conduit which extends along said central axis. Also the mixer includes a first elongated inclined baffle member positioned in said fluid flow path at a first location in said conduit and a second elongated inclined baffle member positioned in said fluid flow path at a second location in said conduit. The second location is offset circumferentially from the first location and the same is spaced longitudinally of the conduit from said first location. The arrangement of the baffle members is such that the mixer includes no additional baffle members which are aligned either circumferentially or longitudinally with either the first baffle member or the second baffle member.

In another broad aspect, the invention provides a static fluid mixer comprising an elongated fluid flow conduit having a centrally located longitudinally extending axis and an inner generally cylindrical wall extending around said axis and defining a fluid flow path within the conduit which extends along said central axis. The mixer includes a first elongated inclined baffle member positioned in said fluid flow path at a first location in said conduit. The first baffle member is in the form of a plate having an upstream end, a downstream end and a longitudinal axis. The upstream end of the first baffle member is spaced radially from the wall a first distance which is less than a radius of the conduit, and the downstream end of the first baffle member is spaced radially from the conduit a second distance which is greater than said first distance.

The mixer further includes a second elongated inclined baffle member positioned in said fluid flow path at a second location in said conduit. The second baffle member also is preferably in the form of a plate having an upstream end, a downstream end and a longitudinal axis. The upstream end of the second baffle member is spaced radially from the wall a third distance which is less than the radius of the conduit and the downstream end of the first baffle member is spaced radially from the wall a fourth distance which is greater than said third distance. Preferably the second and fourth distances are such that the baffle members span approximately 70 percent of the diameter of the conduit. It is also preferred that the first and third distances comprise approximately 4 percent of the diameter of the conduit. The second location in the conduit is preferably offset circumferentially from the first location and spaced longitudinally of the conduit a fifth distance from said first location.

The mixer may also include a mounting element for each of said baffle members. Preferably these mounting elements may extend radially of the conduit between a downstream face of a respective baffle and said wall. Ideally, the mounting elements may each be in the form of a member having an edge which contacts the wall of the conduit along a line which is essentially parallel with the central axis. Alternatively at least one of the mounting elements may be in the form of a sparger pipe.

In a preferred form of the invention, the baffle members are of essentially the same shape, the first and third distances are essentially the same, and the second and fourth distances are essentially the same. Ideally, the members may be plates which are trapezoidal in shape. Ideally, the first and third distances are sufficiently large to permit portions of the fluid flowing through the conduit to pass between the upstream ends of the baffle members and the wall.

In yet another preferred aspect of the invention, the downstream ends of the baffle plate members may have laterally spaced corners which are arranged to create counter-rotating vortices in the fluid flowing through the conduit. This arrangement facilitates thorough mixing of the materials flowing through the conduit.

In another preferred form of the invention, the longitudinal distance between the first and second locations where the baffle members are positioned should be in the range of from approximately 2 times to approximately 10 times greater than the radius of the conduit. Ideally, such longitudinal distance may be approximately 4 times larger than said radius.

Preferably, the baffle members may be offset circumferentially approximately 90° apart. In addition, in accordance with another preferred aspect of the invention, a longitudinal axis of each of the baffle members may be inclined at an angle in the range of from about 20 to about 60 degrees relative to the central axis of the conduit. Even more preferably, the longitudinal axes of the baffle members may be inclined at an angle in the range of from about 30 to about 50 degrees relative to the central axis of the conduit. Ideally, the longitudinal axes of the baffle members may each be inclined at an angle of about 35 degrees relative to the central axis of the conduit. In accordance with another preferred aspect of the invention, the upstream ends of the baffle members may be inclined at an angle of about 90 degrees relative to said axis.

The baffle members may ideally be plates which are trapezoidal in shape with downstream ends which are smaller than the upstream ends. In accordance with the principles and concepts of the invention, the baffle plates may have any one of a variety of shapes and configurations. That is to say, the members may be plates which are essentially planar in traverse cross-sectional configuration. Alternatively, the members may be essentially non-planar in traverse cross-sectional configuration, essentially concave in traverse cross-sectional configuration, essentially convex in traverse cross-sectional configuration, or essentially V-shaped in traverse cross-sectional configuration. The baffle members may also include a hollow internal or external passageway providing a flow path for introducing an additive into a flow of fluids passing through the conduit. Alternatively, the baffle members may be in the form of porous and/or foraminous plates.

The invention further provides a method of mixing one or more fluid streams comprising providing a static fluid mixer as described above and causing one or more fluid streams to flow along the fluid flow path defined by the conduit. The invention also provides a method of mixing solid particles with one or more fluid streams comprising providing a static fluid mixer as described above and causing a stream of solid particles and one or more fluid streams to flow along the fluid flow path defined by the conduit.

BRIEF DESCRIPTION OF THE DRAWINGS

FIGS. 7 through 14 are views showing a variety of useful configurations for baffle members which include sparger pipes and the like.

DETAILED DESCRIPTION OF THE PREFERRED EMBODIMENTS

Figure 1:
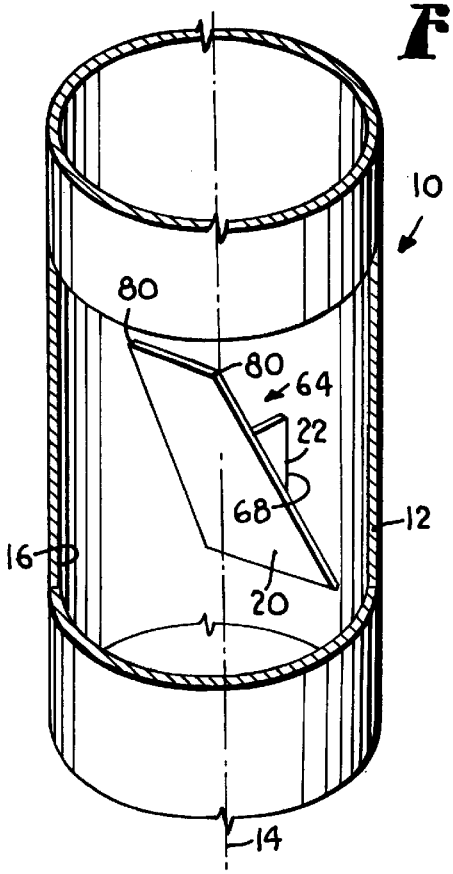
FIG. 1 is an isometric view, partly in cross-section, illustrating the internal components of a static mixer which embodies the principles and concepts of the invention.
Figure 2:
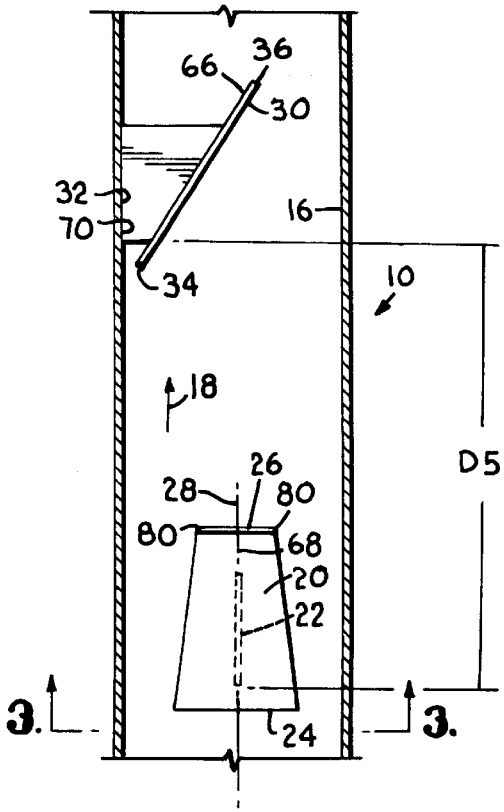
FIG. 2 is a front elevational view of the static mixer of FIG. 1.
Figure 3:
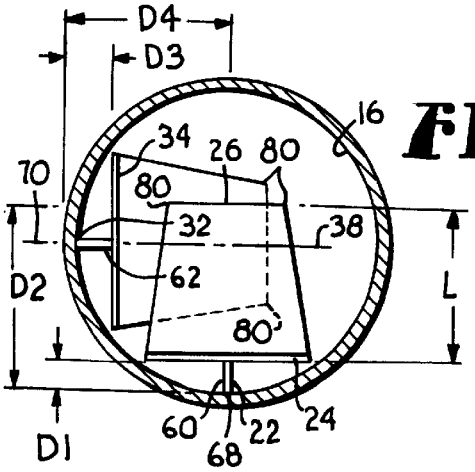
FIG. 3 is a cross-sectional view taken along line 3—3 of FIG. 2.

Referring now to the drawings in greater detail, and initially to FIGS. 1–3, a static fluid mixer which embodies the concepts and principles of the invention is identified by the reference numeral 10. Mixer 10 includes an elongated fluid flow conduit 12 having a centrally located longitudinally extending axis 14 and an inner generally cylindrical wall 16 extending around axis 14. Conduit 12 defines a fluid flow path 18 therewithin. An elongated baffle member in the form of plate 20 is positioned in flow path 18 at a location 22 on wall 16. Plate 20 has an upstream end 24, a downstream end 26 and a longitudinal axis 28. Upstream end 24 is preferably spaced radially a distance D1 from location 22 on wall 16. As can be seen in the drawings, distance D1 is generally less than the radius of conduit 12. For that matter, end 24 may be positioned in contact with wall 16 with adequate results in such configuration is desirable. Since plate 20 projects across flow path 18, it is clear that downstream end 26 will be spaced radially from location 22 a distance D2 which is greater than distance D1.

Another elongated inclined baffle member in the form of a plate 30 is positioned in flow path 18 at a location 32 on wall 16. Plate 30 has an upstream end 34, a downstream end 36 and a longitudinal axis 38. Upstream end 34 is also preferably spaced radially from location 32 on wall 16 a distance D3 which again is less than the radius of conduit 12. Downstream end 36 is spaced radially from location 32 a distance D4 which is greater than distance D3. As can be seen viewing FIG. 3, plates 20 and 30 may preferably be trapezoidal in shape and the lateral dimensions of downstream ends 26 and 36 may preferably be less than the respective lateral dimensions of upstream ends 24 and 34.

As can be seen in FIG. 2, locations 22 and 32 and therefore baffle plates 20 and 30 are spaced apart longitudinally of conduit 12 a distance D5. With reference to FIG. 3 it can be seen that locations 22 and 32 and therefore baffle plates 20 and 30 are also offset circumferentially about the axis 14, preferably at an angle of about 90°; however, the desired offset angle may be more or less than 90° as may be determined empirically depending upon the nature of the fluid to be mixed. The distance D5 between locations 22 and 32 may preferably be within the range of from about 2 to about 10 times as large as the internal radius of conduit 12. Ideally, the distance D5 should be about 4 times as large as the internal radius of conduit 12.

Ideally, in accordance with the concepts and principles of the invention, baffle plates 20 and 30 may be of the same shape. Moreover, the distances D1 and D3 may preferably be about the same, and the distances D2 and D4 may also be about the same. The distances D1 and D3 should preferably be sufficient to permit portions of the fluid flowing along flow path 18 and thereby through conduit 12 to pass between upstream ends 24 and 34 and wall 16. This may prevent eddy currents and dead spots from developing behind plates 20 and 30.

Plates 20 and 30 may preferably have a longitudinal dimension L that is sufficient to span 50 to 75 percent of the diameter of conduit 12. Ideally this dimension L should be such that the plates span about 70 percent of the diameter of conduit 12. Moreover, plates 20 and 30 may preferably be inclined at an angle within the range of from about 20 to about 60 degrees relative to axis 14. Even more preferably this angle of inclination may be within the range of from about 30 to about 50 degrees. Ideally this angle of inclination may be about 35 degrees. As can be seen from FIGS. 3 and 4, the upstream ends 24 and 34 of plates 20 and 30 may preferably be relatively straight and the same may extend laterally at an angle of approximately 90 degrees relative to axis 14.

With reference particularly to FIGS. 1 through 3, it is also preferred that the downstream ends 26 and 36 of plates 20 and 30 provide laterally spaced corners 80 to create counter-rotating vortices 40 in the fluid passing through conduit 12 along path 18. These vortices 40 work together to insure thorough mixing of the materials to be mixed throughout the entire extent of the interior of conduit 12.

Baffle plates 20 and 30 may be connected to wall 16 by respective mounting braces in the form of plates 60 and 62 which extend radially of conduit 12 between wall 16 and the respective downstream faces 64 and 66 of plates 20 and 30. As shown, plates 60 and 62 have respective edges 68 and 70 which contact wall 16 on a line which extends longitudinally of conduit 12 along the flow path 18. Braces 60 and 62 preferably comprise flat plates that may be affixed to the conduit wall 16 and faces 64 and 66 of the baffle members 20 and 30 by welding or the like. The braces 60 and 62 are oriented so as to present as small a profile as possible in the direction of fluid flow and preferably lies in a plane parallel to the direction of fluid flow. Instead of directly affixing the braces 60 and 62 to the conduit wall 16, the braces may just as well be attached to a ring structure that is inserted into the conduit 16 and is in turn affixed to the conduit wall by friction or other suitable means. An advantage of such a ring structure is it can be readily removed or replaced and can be used to quickly retrofit an existing conduit.

The conduit 12 in which the baffle members 20 and 30 are positioned may be a pipe, duct, tube, trough or other device for carrying one or more fluid streams. The conduit is typically of circular cross-section, but may instead by oval, square, rectangular or other desired polygonal or other shape. The conduit may include a sparger pipes 85 (FIGS. 7–14) or other device for introducing one or more fluids or substances such as solid particles into the main fluid flow channel in a known manner and location. The sparger pipe 85 may also be used as a mounting element for one or more of the baffle members as shown in FIGS. 7–10.

Figure 4:
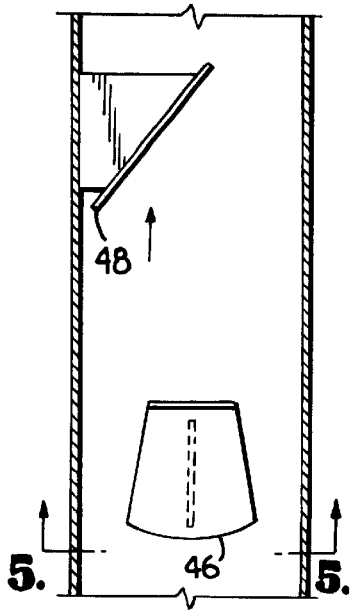
FIG. 4 is a front elevational view of another static mixer which embodies the principles and concepts of the invention, but with a different baffle configuration than the mixer of FIGS. 1, 2, and 3.
Figure 5:
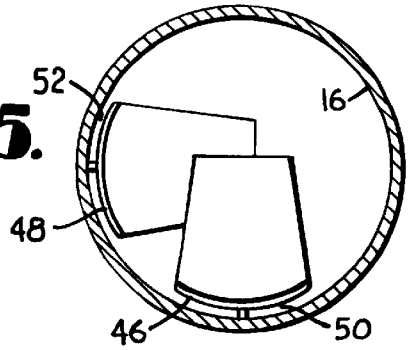
FIG. 5 is a cross-sectional view taken along line 5—5 of FIG. 4.

With reference to FIGS. 4 and 5, another embodiment of the invention is shown. In this embodiment, the arrangement is essentially the same as the embodiment of FIGS. 1, 2 and 3, except that the upstream ends 46 and 48 of the baffle plates are arcuate and have a configuration which corresponds generally with the curvature of wall 16. Accordingly, arcuate slots 50 and 52 are presented between wall 16 and the arcuate ends 46 and 48. As before, slots 50 and 52 should be of ample size to permit portions of the fluid flowing through conduit 12 to pass between ends 46 and 48 and wall 16. Preferably, to accomplish this purpose, the width of slots 50 and 52 may ideally be about 4 percent of the internal diameter of conduit 12.

Although other known vortex static mixers are known to employ two or more baffle members at each of multiple locations along the axial length of the conduit, the present invention is directed to the use of only a single baffle member at each of two locations spaced a preselected distance apart in the direction of fluid flow within the conduit, and offset a preselected degree along the conduit wall in the traverse direction. This arrangement of baffle members allows a distribution of inhomogeneity over the entire cross section of conduit in a first main mixing direction as the fluid stream encounters the first baffle members, followed by distribution of the inhomogeneity over the entire cross section of the conduit in a second main direction as the fluid stream encounters the second baffle member. By orienting the baffle members with an approximately 90 degree offset, the first and second main mixing directions are similarly offset so that more complete and uniform mixing can occur with resulting increases in homogeneity. In addition, the use of only a single baffle member at each location facilitates uniform mixing across the entire conduit cross section by allowing the two counter-rotating vortices generated by each baffle member to expand across the entire cross section of the conduit. The use of multiple baffle members at each location might otherwise cause maldistribution of the fluid stream as a result of the production of multiple, interfering vortices.

Sparger pipes used for introducing or mixing additives, such as additional fluid streams or substances, are preferably positioned so that they do not interfere with the counter-rotating vortices formed by the baffle members. Sparger pipes may preferably be located upstream from, or at, the upstream baffle member so that the additives are introduced upstream from the baffle member, at one or more locations along the upstream face of the baffle member, or even along the downstream face of the baffle member so that a portion of the fluid flowing along the flow path flows around the outside of the baffle member while another portion is introduced downstream of the baffle member. In applications where the additive fluid and the main fluid stream have substantially different densities, it may be particularly desirable to dose the additive fluid at and along the surface of the baffle member so that the fluids are immediately mixed together, thereby reducing the influence of the density difference on the mixing performance. Examples of different dosing structures which may be employed in connection with the present invention are illustrated in FIGS. 7 through 14.

Figure 9:
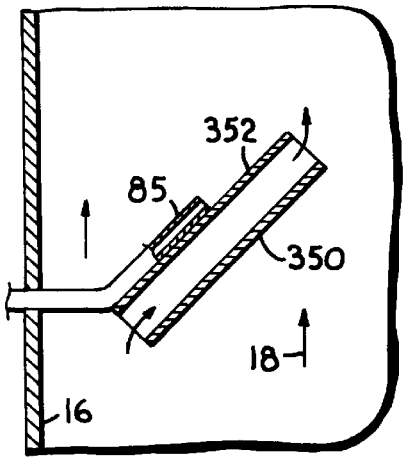
Figure 10:
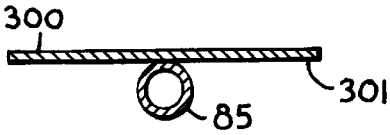
Figure 11:
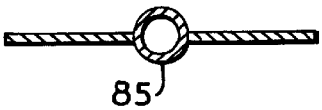
Figure 12:
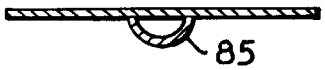
Figure 13:
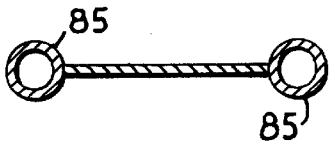
Figure 14:
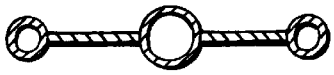

In this latter regard, FIG. 9 illustrates a particularly preferred example of a dosing structure comprising a sparger pipe 85. In FIG. 9, sparger pipe 85 lies on the downstream face 352 of a baffle member 350 which is in the form of a plate. Sparger pipe 85 may be affixed to face 352 by welding or the like. With this arrangement, sparger pipe 85 may provide a mounting element for baffle plate 350. In FIG. 11, the sparger pipe 85 is positioned centrally in the baffle plate. The structure of FIG. 12 is similar to the structure of FIG. 11, except that in this case sparger pipe 85 includes a half round pipe portion that is closed by the baffle plate. The structure of FIG. 13 is again similar to the structure of FIG. 11, except that in this case two sparger pipes 85 are included at the edges of the baffle plate. In FIG. 14, the FIG. 11 structure is combined with the FIG. 13 structure.

Figure 7:
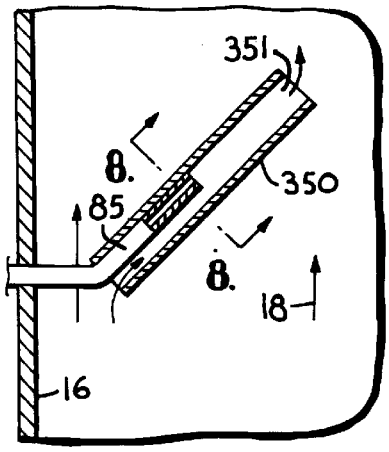
Figure 8:
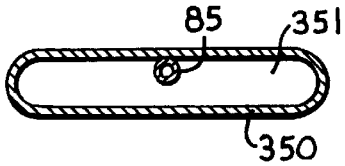

With reference to FIGS. 7 and 8, the baffle member 350 is hollow and provides a conduit 351 for fluid to flow therethrough. Sparger pipe 85 is inserted into conduit 351 and may be affixed to baffle member 350 by welding or the like. Again, as can be seen in FIG. 7, sparger pipe 85 may serve as a mounting element for attaching baffle member 350 to wall 16. In FIG. 9, the construction is similar to the structure of FIGS. 7 and 8, except that in this case the sparger pipe 85 is attached to the downstream face 352 of baffle member 350.

Figure 6:
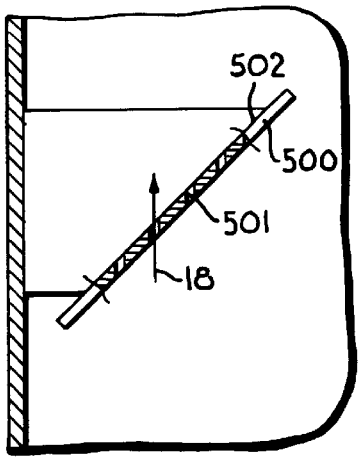
FIG. 6 is an elevational cross-sectional view showing a foraminous baffle member.

The baffle member 500 shown in FIG. 6 is similar to the baffle plates 20 and 30 with the exception that in this case the plate is foraminous. That is to say, a plurality of holes 501 are provided in the plate. These holes 501 act to prevent eddy currents and the like from building up at the downstream face 502 of the plate 500 and allow a portion of the fluid flowing along the flow path to flow through the baffle member 500 while another portion of the fluid flows around the outside of the baffle member 500.

Preferably, if a sparger pipe is employed, the same should be located at an upstream baffle member. A particular advantage of using a single sparger pipe at the upstream baffle location is that such an arrangement allows the entire additive to be dosed at a single location rather than having to be divided into multiple, equal parts for distribution among a plurality of baffle members as in prior constructions. In addition, because the pressure at the backside of the inclined baffle member is lower than at the front side, the upstream end of the baffle member presents a preferred location for dosing of an additive. The pressure differential causes an increase in the velocity of the main fluid stream, increases the inertial force and Froude-number, and reduces the influence that the density difference between the main fluid stream and the additive has on the degree of homogeneity achieved. As a result, in this area of pressure differential there is an immediate, increased dilution effect on the additive by the main stream.

Figure 15:
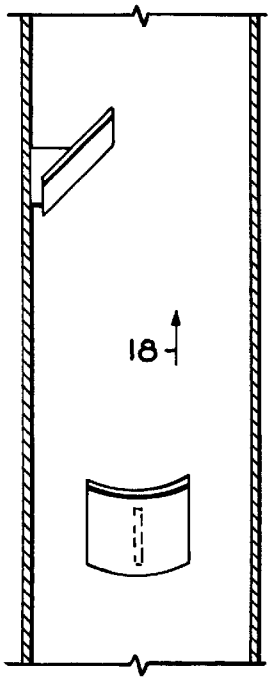
FIGS. 15 through 18 are elevational views showing static mixers of the invention with a variety of alternatively shaped baffle members.
Figure 16:
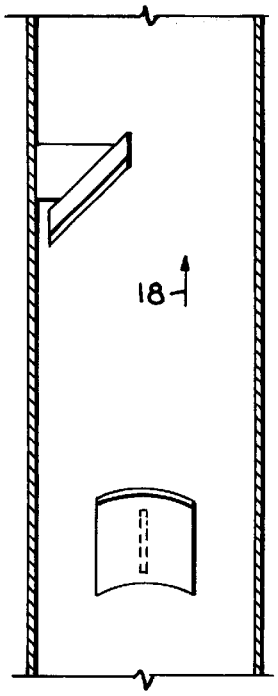
Figure 17:
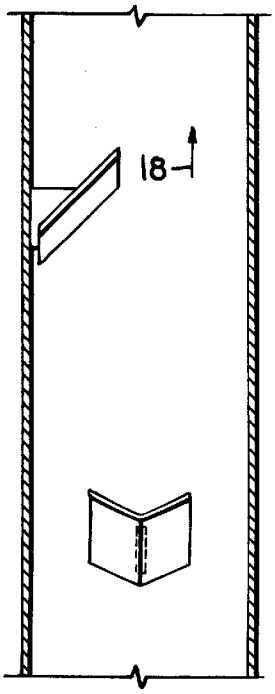
Figure 18:
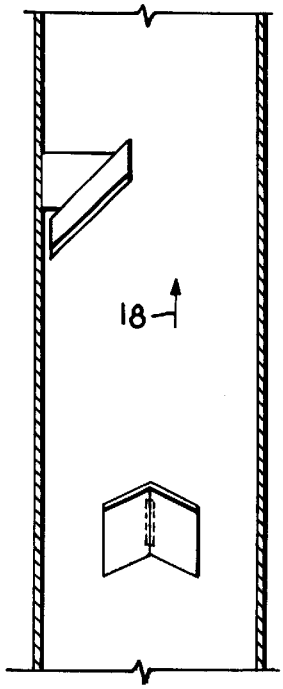

As shown in FIGS. 1 through 5, plates 20 and 30 preferably have a generally planar configuration. However, with reference to FIGS. 15 through 18, a number of different non-planar configurations may be equally useful. Thus, as seen in FIG. 15 the baffle plates may be convex and arcuate, as seen in FIG. 16 the baffle plates may be concave and arcuate, as seen in FIG. 17, the baffle plates may be convex and V-shaped, and as seen in FIG. 18 the baffle plates may be concave and V-shaped.

Because the mixing process is normally completed within a distance of one to three times the conduit diameter downstream from the downstream baffle member, and the distance of separation between the baffle members is on the order of one to five times the conduit diameter, homogeneous mixing can occur within a distance of two to eight times the conduit diameter, and normally three to five times the conduit diameter. In addition to providing effective mixing along a relative short length of conduit, the static mixer of the present invention is particularly notable in that achieves this mixing with a minimum pressure drop and across a wide range of flow rates and ratios of fluids and additives. The relative simple design of the baffle members used in the mixers requires a minimum amount of material and yet is stable and resistance to vibrations that can occur as a result of turbulent fluid flow.

The design of the vortex mixer of the present invention reduces the sensitivity of the mixer to density differences between the main fluid stream and the additive, even at low flow rates and velocities where the Froude-number is extremely small and even small density differences would normally reduce the mixing efficiency or prevent any mixing from occurring. This can be a particular problem in conventional mixer designs when fluids of different densities, such as hot and cold air, hold and cold water, water and an aqueous salt solution or hydrocarbons of different densities, are flowing in straight horizontal flow channels and form stable separate flow layers of fluid.

Although the invention has been described with respect to a two baffle member mixer, in other less preferred embodiments, only a single baffle member or three or more baffle members may be used. When multiple baffle members are used, they are preferably spaced apart in the fluid flow direction, with each baffle member preferably being offset about the periphery of the conduit from each adjacent baffle member. The offset may be 90 degrees, as described with respect to the two baffle member embodiment, or some other selected angle.

The invention is applicable to generally enclosed cylindrical conduits such as pipes and tubes and the like. The invention is also applicable to reclining and/or generally horizontally extending conduits which are not completed enclosed and have an opening, preferably a longitudinally extending opening, at the upper portions thereof. For example, the conduit might by in the form of a horizontally extending ditch or trough or a semicircular piece of pipe having fluids which are moving therealong in a generally horizontal direction. In further accordance with the invention, the mixer may generally simply comprise a relatively short conduit having respective ends which are spaced a short distance beyond said first and second locations so that the mixer may be easily installed and/or removed for maintenance or periodic cleaning.

We claim:

1. A static fluid mixer comprising:

an elongated fluid flow conduit having a centrally located longitudinally extending axis and a generally cylindrical wall extending around said centrally located axis and defining a fluid flow path within the conduit which extends along said centrally located axis;

a first elongated inclined baffle member positioned in said fluid flow path adjacent a first location on an inner surface of the wall, said first baffle member having a series of peripheral edges including an upstream edge, an elongated, laterally extending downstream edge, and a pair of laterally spaced side edges which join with respective laterally spaced ends of said downstream edge of the first baffle member to present a first pair of laterally spaced, external, counter-rotating eddy creating corners, said upstream edge of the first baffle member being spaced radially from the first location a first distance which is less than a radius of the conduit, said downstream edge of the first baffle member being spaced radially from the first location a second distance which is greater than said first distance;

a second elongated inclined baffle member positioned in said fluid flow path adjacent a second location on said inner surface of the wall, said second baffle member having a series of peripheral edges including an upstream edge, an elongated, laterally extending downstream edge, and a pair of laterally spaced side edges which join with respective laterally spaced ends of said downstream edge of the second baffle member to present a second pair of laterally spaced, external, counter-rotating eddy creating corners, said upstream edge of the second baffle member being spaced radially from the second location a third distance which is less than a radius of the conduit, said downstream edge of the second baffle member being spaced radially from the second location a fourth distance which is greater than said third distance; and a respective mounting structure for each of said baffle members, each said structure including a connecting element extending inwardly from said wall to a corresponding baffle member, said baffle member being positioned with said downstream edges, said side edges and said external corners all spaced from said inner surface of said wall whereby at least a portion of the fluid flowing along said flow path flows around the outside of each baffle member between the corners and the wall, said second location being offset circumferentially from said first location and spaced longitudinally of the conduit a fifth distance from said first location, wherein at least one of said baffle members is trapezoidal in shape and the downstream edge of said at least one baffle member is smaller in length than the upstream edge thereof.

2. A static fluid mixer as set forth in claim 1, wherein said baffle members each comprise a plate, said plates being of essentially the same shape.

3. A static fluid mixer as set forth in claim 2, wherein said first and third distances are essentially the same.

4. A static fluid mixer as set forth in claim 3, wherein said second and fourth distances are essentially the same.

5. A static fluid mixer as set forth in claim 2, wherein said second and fourth distances are essentially the same.

6. A static fluid mixer as set forth in claim 1, wherein said first and third distances are essentially the same.

7. A static fluid mixer as set forth in claim 6, wherein said second and fourth distances are essentially the same.

8. A static fluid mixer as set forth in claim 1, wherein said second and fourth distances are essentially the same.

9. A static fluid mixer as set forth in claim 1, wherein said fifth distance is in the range of from about 2 to about 10 times the length of said radius of the conduit.

10. A static fluid mixer as set forth in claim 1, wherein said fifth distance is approximately 4 times the length of said radius of said conduit.

11. A static fluid mixer as set forth in claim 1, wherein said locations are offset approximately 90° apart about a circumference of the wall.

12. A static fluid mixer as set forth in claim 1, wherein said first and third distances are sufficient large to permit respective portions of the fluid flowing through the conduit to pass between said upstream edges and said inner surface of the wall.

13. A static fluid mixer as set forth in claim 1, wherein said first baffle member has a longitudinal axis that extends between the upstream edge and the downstream edge thereof and which is inclined at an angle in the range of from about 20 to about 60 degrees relative to said centrally located axis of said conduit.

14. A static fluid mixer as set forth i claim 13, wherein said longitudinal axis of the first baffle member is inclined at an angle in the range of from about 30 to about 50 degrees relative to said centrally located longitudinally extending axis of said conduit.

15. A static fluid mixer as set forth in claim 14 wherein said longitudinal axis of the first baffle member is inclined at an angle of about 35 relative to said centrally located longitudinally extending axis of said conduit.

16. A static fluid mixer as set forth in claim 1, wherein said baffle members each has a respective longitudinal axis that extends between the upstream edge and the downstream edge thereof and which is inclined at an angle in the range of from about 20 to about 60 degrees relative to said centrally located longitudinally extending axis of said conduit.

17. A static fluid mixer as set forth in claim 16, wherein said longitudinal axes of the baffle members are each inclined at an angle in the range of from about 30 to about 50 degrees relative to said centrally located longitudinally extending axis of said conduit.

18. A static fluid mixer as set forth in claim 17, wherein said longitudinal axes of the baffle members are each inclined at an angle of about 35 degrees relative to said centrally located longitudinally extending axis of said conduit.

19. A static fluid mixer as set forth in claim 1, wherein the upstream edges of said baffle members are inclined at an angle of about 90 degrees relative to said centrally located longitudinally extending axis of said conduit.

20. A static fluid mixer as set forth in claim 1, wherein both of said baffle members are trapezoidal in shape and the downstream edge of each baffle member is smaller in length than the upstream edge thereof.

21. A static fluid mixer as set forth in claim 1, wherein said baffle members are plates which are essentially rectangular in transverse cross-sectional configuration.

22. A static fluid mixer as set forth in claim 1, comprising a mounting element for each of said baffle members, each said mounting element extending radially of the conduit between a downstream face of a respective baffle member and said inner surface of the wall.

23. A static fluid mixer as set forth in claim 22, wherein each said mounting element is generally in the form of a plate having an edge which contacts said surface on a line which extends longitudinally of said conduit.

24. A static fluid mixer as set forth in claim 22, wherein at least one of said baffles members include a hollow passageway therein providing a flow path for introducing an additive into a flow of fluids passing through said conduit.

25. A static fluid mixer as set forth in claim 24, wherein the mounting element for said at least one baffle member comprises a sparger pipe which communicates with said passageway.

26. A static fluid mixer as set forth in claim 22, wherein at least one of said mounting elements comprises a sparger pipe.

27. A static fluid mixer as set forth in claim 1, wherein at least one of said baffles members include a hollow passageway therein providing a flow path for introducing an additive into a flow of fluids passing through said conduit.

28. A static fluid mixer as set forth in claim 1, wherein at least one of said baffle members has a longitudinal dimension extending between the upstream and downstream edges thereof that is sufficiently long to position the upstream and downstream edges of said at least one of said baffle members on opposite sides of the centrally located longitudinally extending axis.

29. A static fluid mixer as set forth in claim 28, wherein said longitudinal dimension is such that said least one baffle member spans 70 percent of the diameter of the conduit.

30. A static fluid mixer as set forth in claim 1, wherein each of said baffle members has a longitudinal dimension extending between the upstream and downstream edges thereof that is sufficiently long to position the upstream and downstream edges of each respective baffle member on opposite sides of the centrally located longitudinally extending axis.

31. A static fluid mixer as set forth in claim 30, wherein each said longitudinal dimension is such that each of the baffle members spans 70 percent of the diameter of the conduit.

32. A static fluid mixer as set forth in claim 1, wherein at least one of said baffle members comprise a sheet having perforations which extend therethrough.

33. A mixer as set forth in claim 1, wherein the arrangement of said baffle members is such that said mixer includes no additional baffle members which are aligned either circumferentially or longitudinally with either said first baffle member or said second baffle member.

34. A static fluid mixer as set forth in claim 1, comprising a mounting element for at least one of said baffle members, said mounting element extending radially of the conduit between a downstream face of said at least one baffle member and said inner surface of the wall.

35. A static fluid mixer as set forth in claim 34, wherein said mounting element is generally in the form of a plate having an edge which contacts said surface on a line which extends longitudinally in said conduit.

36. A static fluid mixer comprising:

an elongated fluid flow conduit having a centrally located longitudinally extending axis and a generally cylindrical wall extending around said centrally located axis and defining a fluid flow path within the conduit which extends along said centrally located axis;

a first elongated inclined baffle member positioned in said fluid flow path adjacent a first location on an inner surface of the wall, said first baffle member including a downstream portion presenting an elongated downstream peripheral edge and a pair of external, counter-rotating eddy creating corners, located at respective opposite ends of the peripheral edge of the first baffle member, said peripheral edge and said external corners of the first baffle member being spaced from said surface;

a second elongated inclined baffle member positioned in said fluid flow path adjacent a second location on said inner surface of the wall, said second baffle member including a downstream portion presenting an elongated downstream peripheral edge and a pair of external, counter-rotating eddy creating corners located at respective opposite ends of the peripheral edge of the second baffle member, said peripheral edge and said external corners of the second baffle member being spaced from said surface, wherein at least one of said baffle members is trapezoidal in shape and the downstream edge of said at least one baffle member is smaller in length than the upstream edge thereof; and a respective mounting structure for each of said baffle members, each said structure including a connecting element extending inwardly from said wall to a corresponding baffle member, the arrangement of said baffle members being such that said mixer includes no additional baffle members which are aligned either circumferentially or longitudinally with either said first baffle member or said second baffle member.

37. A mixer as set forth in claim 36, wherein said baffle members each comprise a plate.

38. A mixer as set forth in claim 36, wherein said baffle members are of essentially the same shape.

39. A mixer as set forth in claim 38, wherein said baffle members each comprise a plate.

40. A mixer as set forth in claim 36, wherein at least one of said baffle members comprises a plate.

41. A static fluid mixer as set forth in claim 36, wherein both of said baffle members are trapezoidal in shape and the downstream edge of each baffle member is smaller in length than the upstream edge thereof.

42. A static fluid mixer comprising:

an elongated fluid flow conduit having a centrally located longitudinally extending axis and a wall extending at least part way around said centrally located axis and defining a fluid flow path within the conduit which extends along said centrally located axis;

a first elongated inclined baffle member positioned in said fluid flow path adjacent a first location on an inner surface of the wall, said first baffle member having a series of peripheral edges including an upstream edge, an elongated, laterally extending downstream edge, and a pair of laterally spaced side edges which join with respective laterally spaced ends of said downstream edge of the first baffle member to present a first pair of laterally spaced, external, counter-rotating eddy creating corners, said upstream edge of the first baffle member being spaced radially from the first location a first distance which is less than ½ of a lateral dimension of the conduit but which is sufficiently large to permit a portion of the fluid flowing through the conduit to pass between said upstream edge of the first baffle member and said inner surface of the wall, said downstream edge of the first baffle member being spaced from the first location a second distance which is greater than said first distance;

a second elongated inclined baffle member positioned in said fluid flow path adjacent a second location on an inner surface of the wall, said second baffle member having a series of peripheral edges including an upstream edge, an elongated, laterally extending downstream edge, and a pair of laterally spaced side edges which join with respective laterally spaced ends of said downstream edge of the second baffle member to present a second pair of laterally spaced, external, counter-rotating eddy creating corners, said upstream end edge of the second baffle member being spaced radially from the second location a third distance which is less than ½ of a lateral dimension of the conduit but which is sufficiently large to permit a portion of the fluid flowing through the conduit to pass between said upstream edge of the second baffle member and said inner surface of the wall, said downstream edge of the second baffle member being spaced from the second location a fourth distance which is greater than said third distance, wherein at least one of said baffle members is trapezoidal in shape and the downstream edge of said at least one baffle member is smaller in length than the upstream edge thereof; and a respective mounting structure for each of said baffle members, each said structure including a connecting element extending inwardly from said wall to a corresponding baffle member, said baffle member being positioned with said downstream edges, said side edges and said external corners all being spaced from said inner surface of said wall whereby at least a portion of the fluid flowing along said flow path flows around the outside of each baffle members between the corners and the wall, said second location being offset circumferentially from said first location and spaced longitudinally of the conduit a fifth distance from said first location.

43. A static fluid mixer as set forth in claim 42, wherein both of said baffle members are trapezoidal in shape and the downstream edge of each baffle member is smaller in length than the upstream edge thereof.

44. A static fluid mixer comprising:

an elongated fluid flow conduit having a centrally located longitudinally extending axis and a wall extending at least part way around said centrally located axis and defining a fluid flow path within the conduit which extends along said centrally located axis;

a first elongated inclined baffle member positioned in said fluid flow path adjacent a first location on an inner surface of the wall, said first baffle member including a downstream portion presenting an elongated downstream peripheral edge and a pair of external, counter-rotating eddy creating corners, located at respective opposite ends of the peripheral edge of the first baffle member, said peripheral edge and said external corners of the first baffle member being spaced from said surface;

a second elongated inclined baffle member positioned in said fluid flow path adjacent a second location on said inner surface of the wall, said second baffle member including a downstream portion presenting an elongated downstream peripheral edge and a pair of external, counter-rotating eddy creating corners located at respective opposite ends of the peripheral edge of the second baffle member, said peripheral edge and said external corners of the second baffle member being spaced from said surface, said second location being offset circumferentially from said first location and spaced longitudinally of the conduit from said first location, wherein at least one of said baffle members is trapezoidal in shape and the downstream edge of said at least one baffle member is smaller in length than the upstream edge thereof; and a respective mounting structure for each of said baffle members, each said structure including a connecting element extending inwardly from said wall to a corresponding baffle member, the arrangement of said baffle members being such that said mixer includes no additional baffle members which are aligned either circumferentially or longitudinally with either said first baffle member or said second baffle member.

45. A static fluid mixer as set forth in claim 44, wherein both of said baffle members are trapezoidal in shape and the downstream edge of each baffle member is smaller in length than the upstream edge thereof.

46. A static fluid mixer as set forth in claim 48 or 44, wherein said conduit is cylindrical.

47. A static fluid mixer as set forth in claim 1, 36, 42 or 44, wherein said conduit is in an essentially upright position.

48. A static fluid mixer as set forth in claim 1, 36, 42, or 44, which comprises a conduit having respective ends, said first location being adjacent one of said ends and said second location being adjacent another of said ends.

49. A static fluid mixer as set forth in claim 1, 36, 42, or 44, wherein said conduit is circular in transverse cross-sectional configuration.

* * * * *